US011879704B2

(12) United States Patent
Bowmar

(10) Patent No.: US 11,879,704 B2
(45) Date of Patent: Jan. 23, 2024

(54) BOW GRIP AID

(71) Applicant: Bowmar Archery LLC, Des Moines, IA (US)

(72) Inventor: Josh Bowmar, Ankeny, IA (US)

(73) Assignee: Bowmar Archery LLC, Des Moines, IA (US)

( * ) Notice: Subject to any disclaimer, the term of this patent is extended or adjusted under 35 U.S.C. 154(b) by 0 days.

(21) Appl. No.: 17/447,374

(22) Filed: Sep. 10, 2021

(65) Prior Publication Data

US 2023/0079443 A1 Mar. 16, 2023

(51) Int. Cl.

| | |
|---|---|
| ***F41B 5/14*** | (2006.01) |
| ***A63B 53/14*** | (2015.01) |
| ***A63B 60/12*** | (2015.01) |
| ***A63B 60/10*** | (2015.01) |
| *F41B 5/00* | (2006.01) |

(52) U.S. Cl.

CPC ..... *F41B 5/1476* (2013.01); *A63B 60/10* (2015.10); *A63B 60/12* (2015.10); *A63B 53/14* (2013.01); *F41B 5/0031* (2013.01)

(58) Field of Classification Search

CPC ..... F41B 5/1476; F41B 5/0031; F41B 5/148; F41B 5/1442; F41B 5/14; A63B 53/14; A63B 60/10; A63B 60/12

See application file for complete search history.

(56) References Cited

U.S. PATENT DOCUMENTS

| | | | | | |
|---|---|---|---|---|---|
| 4,402,508 | A * | 9/1983 | Pflueger | A63B 49/08 | 473/551 |
| 4,787,361 | A * | 11/1988 | Vyprachticky | F41B 5/14 | 124/24.1 |
| 4,848,746 | A * | 7/1989 | Klink | A63B 60/08 | 473/203 |
| 5,155,878 | A * | 10/1992 | Dellis | A63B 60/08 | 264/222 |
| 5,322,286 | A * | 6/1994 | Frost | A63B 60/10 | 473/568 |
| 5,398,930 | A * | 3/1995 | Gibson | A63B 60/10 | 473/201 |
| 5,469,834 | A * | 11/1995 | Higgins | F41B 5/14 | 124/88 |

(Continued)

FOREIGN PATENT DOCUMENTS

DE 3202194 A1 8/1983

*Primary Examiner* — John E Simms, Jr.

(74) *Attorney, Agent, or Firm* — Banner & Witcoff, Ltd.

(57) ABSTRACT

Shooting accuracy in archery may be greatly improved by increasing the precision and repeatability in which an archer establishes "anchor points," which are contact points between the archer and a drawn bow and arrow at a moment of launch. One such contact point is the hand gripping the bow grip. The invention provides a bow grip aid which enables an archer to repeatably grip the same location of the bow grip and maintain consistent grip firmness from one shot to the next. Reducing variances of this aspect of the archer's form benefits the archer by reducing variances between the archer's sighting process and determination of point of aim, and the impact point of the arrow on its target. The invention helps archers grip a bow more consistently so they can consistently place each arrow where they want it to go.

18 Claims, 5 Drawing Sheets

(56) References Cited

U.S. PATENT DOCUMENTS

| | | | | |
|---|---|---|---|---|
| 5,842,460 | A * | 12/1998 | Barber | F41B 5/14 124/88 |
| 7,022,025 | B1 * | 4/2006 | Cascerceri | A63B 53/14 473/549 |
| 7,125,353 | B2 * | 10/2006 | Blount | A63B 60/08 473/568 |
| 8,622,052 | B1 * | 1/2014 | McPherson | F41B 5/14 124/88 |
| 10,648,761 | B1 * | 5/2020 | Elezar | F41B 5/00 |
| 2004/0242341 | A1 | 12/2004 | McDonald | |
| 2007/0254753 | A1 * | 11/2007 | Bleecker | A63B 60/10 473/568 |
| 2008/0032831 | A1 | 2/2008 | Schroeder | |
| 2010/0184525 | A1 * | 7/2010 | Kurisu | A63B 69/3632 473/206 |
| 2011/0259309 | A1 * | 10/2011 | Oppenheim | F41B 5/14 124/88 |
| 2014/0174417 | A1 * | 6/2014 | Vyprachticky | F41B 5/14 124/88 |
| 2014/0196705 | A1 * | 7/2014 | White | F41B 5/0031 124/88 |
| 2020/0149839 | A1 * | 5/2020 | Grace | F41B 5/1476 |
| 2023/0277901 | A1 * | 9/2023 | Henningsen | A63B 49/035 473/226 |

* cited by examiner

A - A

A - A

B - B

B - B

B - B

BOW GRIP AID

TECHNICAL FIELD

The invention relates to archery products which assist in establishing repeatable and reliable anchor points for the archer and bow.

BACKGROUND

Accuracy in archery is gained by repeated visceral learning experiences of which muscle positions of the entire body result in which ranges and impact points of the arrows. According to some techniques, an archer sights along an arrow shaft, but in other techniques the arrow axis at launch is offset from a line of sight from the archer's aiming eye to the target or to an aiming structure on the bow, arrow, or string, so that the repeatable grip locations which establish a desired launch angle must also be learned by experience and muscle memory which is not often or easily transferable from one bow and arrow system to another, nor easily transferable from one user to another user of the same system. Thus, despite its ancient history, many challenges for repeatability and reproducibility remain unsolved in the field of archery, and opportunities abound for inventive accessories and improvements which overcome traditional limitations.

SUMMARY

Accuracy in archery depends on an archer being able to establish identical geometrical conditions of draw position, arrow launch angle, and sighting geometry from the archer's eye to sighting aids incorporated into the bow and sometimes the bow string as well, and the target in view of the archer. These relationships include "anchor points" which are points on the archer's body which contact specific parts of the bow and fine-tuned accessories of the bow and bow string. These relationships must be repeatably and reliably established from one shot to the next. An archer able to master repeatably setting up anchor points and aided by modern archery accessories such as bow string draw stops, nose buttons, and peep sights may enjoy exceptional accuracy in sports, competition, hunting, and the profound pleasure of achieving the challenging and exacting result of putting an arrow exactly where it is desired to go, at any range and environmental conditions.

One anchor point which finds opportunities for improvement is the assisting an archer in gripping the bow frame or bow grip at exactly the same location, so that the arrow rest on the bow is the same height above a reference point of the grip hand from one shot to the next. Thus a primary objective of the invention is to provide a tactile aid to the archer so that a preferred grip location can be defined and repeatably established.

Bones of the gripping arm and hand are substantially rigid, and the bow material in its grip area is also substantially rigid, but the tissues of the gripping hand are not. Thus an additional objective of the invention is to provide tactile feedback to the archer relating to the firmness of the gripping hand, so that a repeatable sense of exactly where and how hard to grip the bow may be learned with practice.

As a corollary objective, the invention greatly accelerates this learning process, and like in many other sports, people will practice longer and more often when they recognize that they are improving.

These and other features, advantages, and objects of the present disclosure will be further understood and appreciated by those skilled in the art by reference to the following specification, claims, and appended drawings, where various embodiments of the design illustrate how concepts of this disclosure may be used.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION

Figure 1A:
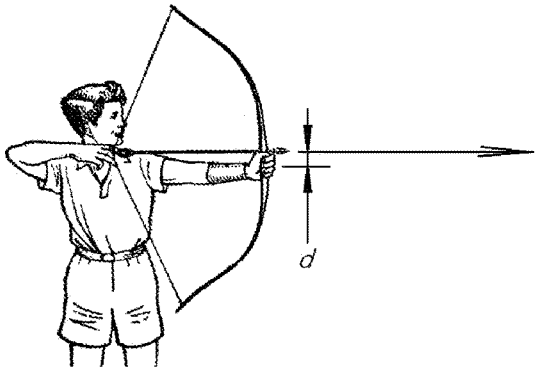
FIG. 1*a* shows a side view of an archer gripping a bow with the gripping hand prehending a region of the bow grip which is a desired location on the grip and is thus an anchor point.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. The phrase "substantially perpendicular" in this specification shall mean a geometric relationship by which a first entity resides within 15° of perpendicularity or orthogonality with respect to a second entity.

The invention relates to aids which improve shooting accuracy in archery by increasing the precision and repeatability in which an archer establishes "anchor points," which are contact points between the archer and a drawn bow and arrow at a moment of launch. One such contact point is the hand gripping the bow grip. The invention provides a bow grip aid which enables an archer to repeatably grip the same location of the bow grip and maintain consistent grip firmness from one shot to the next. Reducing variances of this aspect of the archer's form benefits the archer by reducing variances between the archer's sighting process and determination of point of aim, and the impact point of the arrow on its target. The invention helps archers grip a bow more consistently so they can consistently place each arrow where they want it to go. In this specification, the bow grip aid is also referred to as a bow grip fixture in light of how jigs and fixtures are used in manufacturing to repeatably and consistently orient a workpiece with respect to a tool, so that an action performed by the tool happens at the exact same point from one piece to the next. Archers endeavor that when they can set up the same anchor points of a drawn bow with respect to the human body, they will be able to send an arrow to the exact same point, shot after shot.

For all figures, reference numerals and reference letters for elements described in any one figure represent the same elements as they appear and are referenced in any other figures, without requiring redundant recitation of the same description in those other figures.

FIG. 1*a* shows a side view of an archer gripping a bow with the gripping hand prehending a region of the bow grip which is a desired location [d] on the grip and is thus an anchor point. With repeated practice the archer will endeavor to correlate the impact point of the arrow with (among other anchor points and repeatable factors) the location of the gripping hand on the bow grip.

Figure 1B:
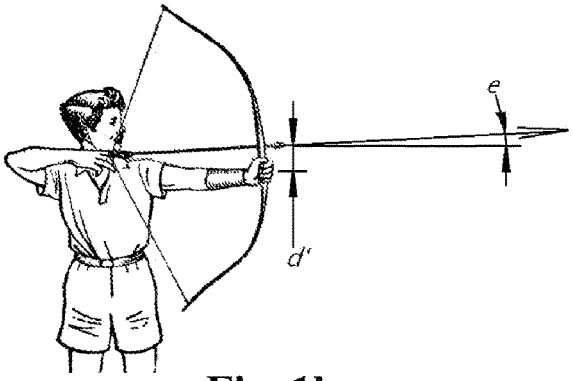
FIG. 1*b* shows a side view of the archer of FIG. 1*a*, but in this case the gripping hand is not located in the preferred region of the bow grip.

FIG. 1*b* shows a side view of the archer of FIG. 1*a* , but in this case the gripping hand is not located in the preferred region of the bow grip but instead, by error or undeveloped skill, the gripping hand is located at a lower location [d'] on the bow grip. Although the archer may be maintaining good control over the other anchor points and good form in all other aspects, the arrow will fly at a different trajectory having an angle of error [e] and impact elsewhere than the arrow of FIG. 1*a* . By reducing the variance of [d] versus [d'] from one shot to the next, impact point accuracy of the arrow may be improved.

Figure 2A:
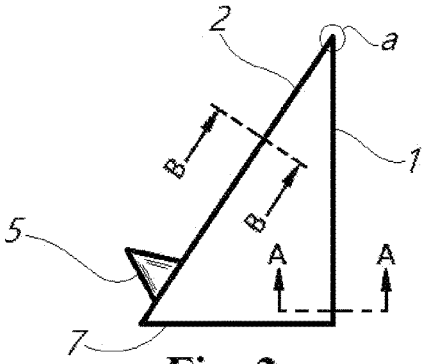
FIG. 2*a* shows a right-side elevation view of an embodiment of a bow grip aid in accordance with the invention, including section lines A-A and B-B for partial cross sections seen in other figures.

FIG. 2*a* shows a right-side elevation view of an embodiment of a bow grip aid in accordance with the invention, including section lines A-A and B-B for partial cross sections seen in other figures. The invention comprises a solid body which may usually be formed as a prism extending from one or both sides of a midplane along a projection contour which may be a straight line or a curved, inflected, or invected contour. The prism is defined by a closed contour residing or lying within the midplane. In the embodiment shown, the closed contour comprises an apex point [a] from which extend an adjacent spline [1] and a hypotenuse spline [2]. A spline in this specification may also be a straight line or a curved, inflected, or invected contour. This closed contour is closed by a distal contour [7] spanning between the distal end points of the adjacent and hypotenuse contours. The solid also includes a protuberance [5] extending from a point on the hypotenuse spline distant from the apex. In this embodiment shown the protuberance is a cone. The cone may comprise a circular or elliptical conic surface.

Figure 2B:
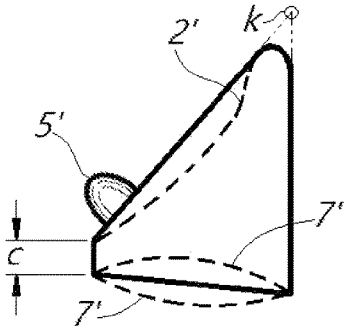
FIG. 2*b* shows a right-side elevation view of an alternative embodiment of a bow grip aid in accordance with the invention.

FIG. 2*b* shows a right-side elevation view of an alternative embodiment of a bow grip aid in accordance with the invention. The hypotenuse contour [2'] and distal contour [7'] may include curves so that when projected they form convex or concave surfaces, or which may also include positively or negatively curved surfaces where the projection contours are other than straight line contours. The protuberance [5'] in this embodiment is an ogive, which may come to a sharp point or may be somewhat rounded or blunted, or otherwise comprise a surface which may include a cone, an ellipsoid surface, or an annular surface such as a fillet at the base of the protuberance.

Also, the closed contour defining the projected solid may include one or more fillet surfaces. As a particular example, if the closed contour is filleted at its apex, then tangent lines extending from the adjacent contour and the hypotenuse contour will meet at an apex point [k] outside of the solid and its closed contour. This theoretical intersection point extends to define a theoretical sharp edge not physically present in the solid, while and said adjacent surface and said hypotenuse surface meet at the fillet surface. Also, rather than being a triangle, an additional portion of the closed contour defining the solid may extend a length [c] from the distal end of the hypotenuse contour so that the closed contour in this embodiment is an irregular trapezoid. Other portions of the closed contour may include filleted corners.

Figure 2C:
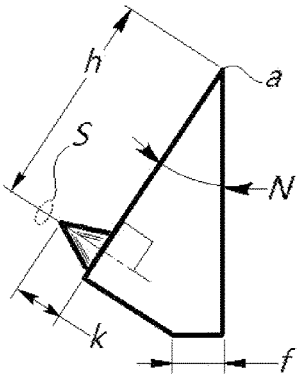
FIG. 2*c* shows a right-side elevation view of another alternative embodiment of a bow grip aid in accordance with the invention.

FIG. 2*c* shows a right-side elevation view of another alternative embodiment of a bow grip aid in accordance with the invention. The projection is a first contour comprising an apex, an adjacent spline, and a hypotenuse spline, with an angle [N] between the adjacent and hypotenuse contours which may reside between 10° and 75°, but with preferred embodiments the angle resides between 25° and 45°.

A protuberance [5] defines a second projection contour [S] originating from the hypotenuse spline at a distal point which is a distance [h] from the apex [a] of the closed contour. Although the second projection contour in this exemplary embodiment is a straight line substantially perpendicular to the hypotenuse spline, the protuberance may also follow a curved contour so that a portion of the protuberance would take on a tapered form like a musical horn or an animal horn. A protuberance in accordance with the invention may also lack a taper and project as a straight-walled stud or a cylindrical pin or dowel.

Also, rather than being a triangle, a different additional portion of the closed contour defining the solid may extend a length [f] from the distal end of the adjacent contour so that the closed contour in this embodiment is an irregular quadrilateral. Other portions of the closed contour may include filleted corners.

Figure 3A:
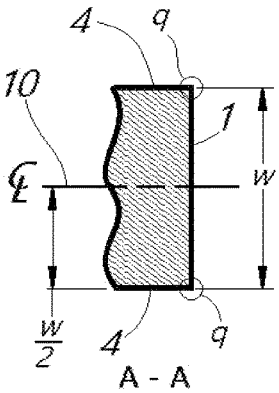
FIG. 3*a* shows a partial cross section view of the bow grip aid of FIG. 2*a* taken at section A-A of that figure.

FIG. 3*a* shows a partial cross section view of the bow grip aid of FIG. 2*a* taken at section A-A of that figure. The solid projects out of the midplane [10] in both orthogonal directions. The midplane in this and other figures defines a centerline of symmetry for the solid which is indicated by symbol ℄ . The portion of the closed contour which is an adjacent spline extends out of the midplane to form an adjacent surface [1] which in this exemplary embodiment is a plane. At this cross section the limits of the plane terminate at two end points [q] defining a width dimension [w] for the solid which in turn defines the distance [w/2] to the midplane from either end point. The limits of extension of the solid from its closed contour at midplane define two sidewalls [4] which in this exemplary embodiment are parallel to the midplane.

Figure 3B:
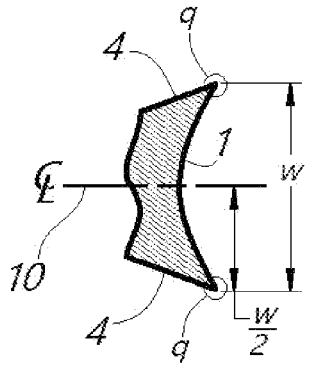
FIG. 3*b* shows a partial cross section view of an alternative embodiment of a bow grip aid in accordance with the invention, taken at section A-A of FIG. 2*a*.

FIG. 3*b* shows a partial cross section view of an alternative embodiment of a bow grip aid in accordance with the invention, taken at section A-A of FIG. 2*a*. In this embodiment the adjacent spline is not projected along a straight line perpendicular to the midplane [10] but rather extends along a curved projection contour passing through the midplane to define a concave adjacent surface [1]. If the adjacent spline also contains a curve, then the adjacent surface may be a positively curved surface such as the interior surface of a razor clam shell.

Despite being curved, the projection contour of the adjacent spline has its end points [q] which define a width dimension [w] for the solid which in turn defines the distance [w/2] to the midplane from either end point. Also in this figure, rather than being parallel to the midplane, the sidewalls are tapered as they extend from the adjacent surface.

Figure 3C:
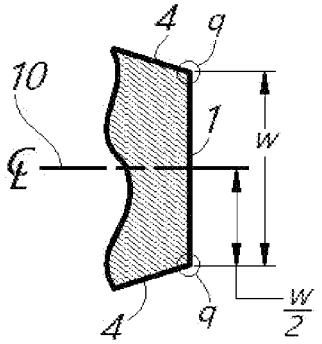
FIG. 3*c* shows a partial cross section view of another alternative embodiment of a bow grip aid in accordance with the invention, taken at section A-A of FIG. 2*a*.

FIG. 3*c* shows a partial cross section view of another alternative embodiment of a bow grip aid in accordance with the invention, taken at section A-A of FIG. 2*a*. Adjacent surface [1] is a plane as seen previously, with its end points [q] defining a midplane [10] also as seen previously. However, in contrast to the solid of FIG. 3*b*, in this embodiment the sidewalls [4] of this embodiment are drafted so that in this region of the part, the part width increases with increasing distance from the adjacent surface.

Figure 4A:
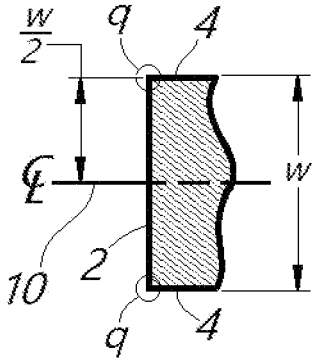
FIG. 4*a* shows a partial cross section view of the bow grip aid of FIG. 2*a* taken at section B-B of that figure.

FIG. 4*a* shows a partial cross section view of the bow grip aid of FIG. 2*a* taken at section B-B of that figure. The solid projects out of the midplane [10] in both orthogonal directions. The portion of the closed contour which is a hypotenuse spline extends out of the midplane to form a hypotenuse surface [2] which in this exemplary embodiment is a plane. At this cross section the limits of the plane terminate at two end points [q] defining a width dimension [w] for the solid which in turn defines the distance [w/2] to the midplane from either end point. The limits of extension of the solid from its closed contour at midplane define two sidewalls [4] which in this exemplary embodiment are parallel to the midplane.

Figure 4B:
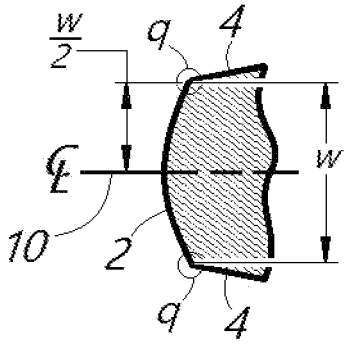
FIG. 4*b* shows an alternative embodiment of a bow grip aid in accordance with the invention, taken at section B-B of FIG. 2*a*.

FIG. 4*b* shows an alternative embodiment of a bow grip aid in accordance with the invention, taken at section B-B of FIG. 2*a*. In this embodiment the hypotenuse spline is not projected along a straight line perpendicular to the midplane [10] but rather extends along a curved projection contour passing through the midplane to define a convex hypotenuse surface [2]. If the hypotenuse spline contains a negative curve, then the hypotenuse surface may be a positively curved surface such as the exterior surface of an avocado or an egg. If the hypotenuse spline contains a positive curve, then the hypotenuse surface may be a negatively curved surface such as a saddle shape.

Despite being curved, the projection contour of the hypotenuse spline has its end points [q] which define a width dimension [w] for the solid which in turn defines the distance [w/2] to the midplane from either end point. Also in this figure, rather than being parallel to the midplane, the sidewalls are tapered as they extend from the hypotenuse surface. These angled draft surfaces or end faces of the projected solid would comport with the sidewalls described in FIG. 3*b*.

Figure 4C:
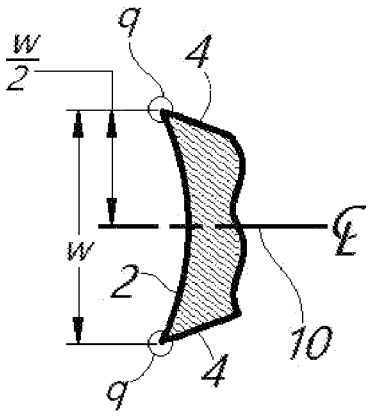
FIG. 4*c* shows a partial cross section view of another alternative embodiment of a bow grip aid in accordance with the invention, taken at section B-B of FIG. 2*a*.

FIG. 4*c* shows a partial cross section view of another alternative embodiment of a bow grip aid in accordance with the invention, taken at section B-B of FIG. 2*a*. The hypotenuse spline is not projected along a straight line perpendicular to the midplane [10] but rather extends along a curved projection contour passing through the midplane to define a concave hypotenuse surface [2]. If the hypotenuse spline also contains a curve, then the hypotenuse surface may be a positively curved surface.

Despite being curved, the projection contour of the hypotenuse spline has its end points [q] which define a width dimension [w] for the solid which in turn defines the distance [w/2] to the midplane from either end point. Also in this figure, rather than being parallel to the midplane, the sidewalls are tapered as they extend from the hypotenuse surface. These angled draft surfaces or end faces of the projected solid would comport with the sidewalls described in FIG. 3*c*.

Figure 4D:
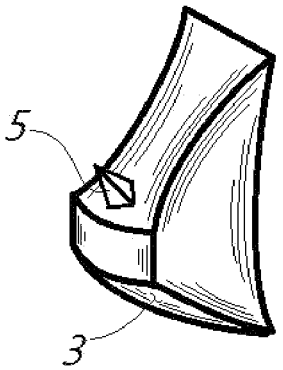
FIG. 4*d* shows an oblique, right rear top view of another alternative embodiment of a bow grip aid in accordance with the invention in which several of its surfaces are convex and concave surfaces.

FIG. 4*d* shows an oblique, right rear top view of another alternative embodiment of a bow grip aid in accordance with the invention in which several of its surfaces are convex and concave surfaces. This solid is but one particular possible embodiment amalgamated from among the many various surfaces and shapes available as defined within the previous figures. With the edge which includes the apex of the closed contour comprising the first edge of the adjacent surface, the edge of the adjacent surface at the opposite end of the adjacent spline from the apex is the second edge of the adjacent surface. This solid also includes a distal surface [3] extending from the second edge of the adjacent surface.

In this particular embodiment the protuberance comprises at least one plane as a planar pyramid. Optional pyramid shapes within the scope of the invention include pyramids having a base contour which may be a polygon, a triangle, a square base, a rectangle, a rhombus, an irregular polygon, or a star. The point of the protuberance may be a sharp point as shown or may be rounded or blunted.

Figure 5A:
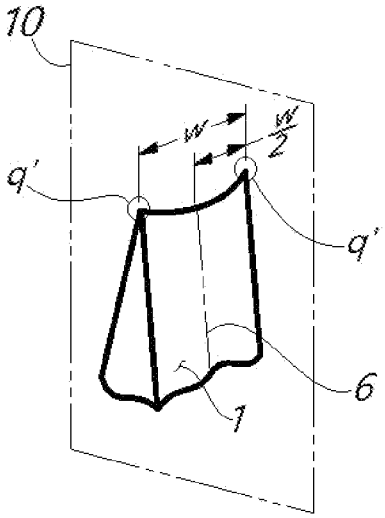
FIG. 5*a* shows an oblique, left top rear view of an apex portion of a bow grip aid in accordance with the invention, including a midplane [10] defining a cutting plane view for FIG. 6*a*.
Figure 6A:
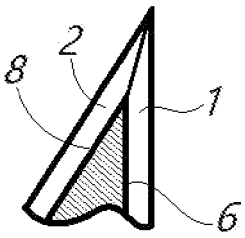
FIG. 6*a* shows a partial cross section view of the apex portion of the bow grip aid of FIG. 5*a*, taken at the midplane [10].

FIG. 5*a* shows an oblique, left top rear view of an apex portion of a bow grip aid in accordance with the invention, including a midplane [10] defining a cutting plane view for FIG. 6*a*. The cutting plane intersects the adjacent surface [1] at the adjacent spline [6] of the closed contour which from which the solid extends orthogonally from the midplane. In this solid embodiment at least the adjacent surface or the hypotenuse surface or both of these surfaces are concave surfaces, so that the apex edge terminates at two end points [q']. The distance between the two end points defines a width dimension [w] for the solid which in turn defines the distance [w/2] to the midplane from either end point.

Figure 5B:
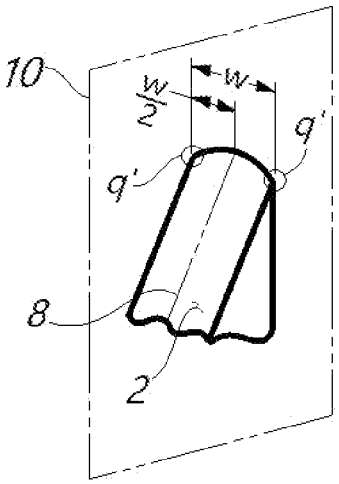
FIG. 5*b* shows an oblique, right top rear view of an apex portion of an alternative embodiment of a bow grip aid in accordance with the invention, including a midplane [10] defining a cutting plane view for FIG. 6*b*.
Figure 6B:
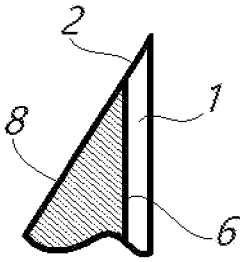
FIG. 6*b* shows a partial cross section view of the apex portion of the bow grip aid of FIG. 5*b*, taken at the midplane [10].

FIG. 5*b* shows an oblique, right top rear view of an apex portion of an alternative embodiment of a bow grip aid in accordance with the invention, including a midplane [10] defining a cutting plane view for FIG. 6*b*. The cutting plane intersects the hypotenuse surface [2] at hypotenuse spline [8] of the closed contour which from which the solid extends orthogonally from the midplane. In this solid embodiment at least the adjacent surface or the hypotenuse surface or both of these surfaces are convex surfaces, so that the apex edge terminates at two end points [q']. The distance between the two end points defines a width dimension [w] for the solid which in turn defines the distance [w/2] to the midplane from either end point.

In the previous FIGS. 5*a* and 5*b*, the sharp apex edge may be replaced by a theoretical sharp edge if the adjacent surface and the hypotenuse surface meet at a fillet surface spanning between them.

FIG. 6*a* shows a partial cross section view of the apex portion of the bow grip aid of FIG. 5*a*, taken at the midplane [10].

FIG. 6*b* shows a partial cross section view of the apex portion of the bow grip aid of FIG. 5*b*, taken at the midplane [10]. In this embodiment the hypotenuse surface [8] may be a plane or may be convex, and the adjacent surface is concave.

Figure 6C:
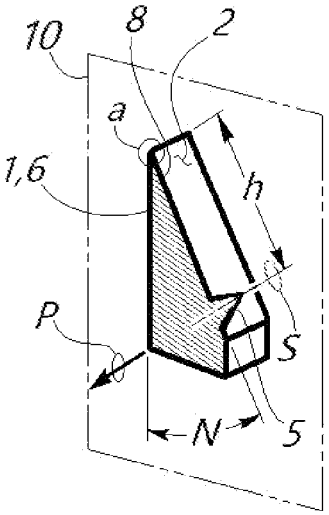
FIG. 6*c* shows the bow grip aid of FIG. 2*a* cut at a midplane [10] and rotated to an oblique, top left rear orientation.

FIG. 6*c* shows the bow grip aid of FIG. 2*a* cut at a midplane [10] and rotated to an oblique, top left rear orientation. The bow grip aid is a fixture comprising the midplane and a solid defining a closed contour lying within the midplane. The closed contour is projected along a first projection contour [P] extending orthogonally to the midplane. The closed contour has an apex [a] and an adjacent spline [6] extending from the apex lying within the midplane, and a hypotenuse spline [8] also extending from the apex. The projection of the apex defines a first edge passing through itself, and an adjacent surface [6] extending from the first edge along its adjacent spline. The projection also defines a hypotenuse [2] surface extending from the first edge along the hypotenuse spline. The solid also includes a protuberance [5] defining a second projection contour [S] originating from the hypotenuse spline. The adjacent and hypotenuse contours subtend an angle [N] between them. The protuberance of this embodiment tapers along the second projection contour.

Figure 6D:
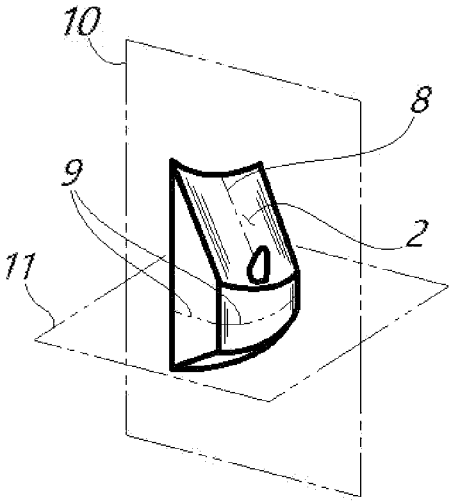
FIG. 6*d* shows an oblique, top left rear view of another alternative embodiment of a bow grip aid in accordance with the invention in which certain thicknesses vary or taper along a profile of projection, including a cutting plane [11] for a cross section view shown in FIG. 6*e*.

FIG. 6*d* shows an oblique, top left rear view of another alternative embodiment of a bow grip aid in accor-dance with the invention, in which certain thicknesses vary or taper along a profile of projection. Besides midplane [10], a cutting plane [11] is shown for a cross section view seen in FIG. 6*e*. The cutting plane intersects the solid at contour [9]. This solid also includes a distal surface extending from a second edge of the hypotenuse surface opposite the first edge which includes the apex of the closed contour defining the solid. The midplane intersects the solid at hypotenuse contour [8] on hypotenuse surface [2].

Figure 6E:
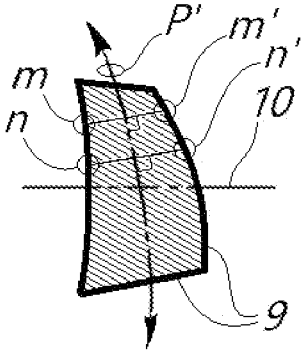
FIG. 6*e* shows a cross section view of the bow grip aid of FIG. 6*d*, taken at the cutting plane [11] of that figure.

FIG. 6*e* shows a cross section view of the bow grip aid of FIG. 6*d*, taken at the cutting plane [11] of that figure. It is possible to fashion a bow grip fixture within the scope of the invention which is a solid which is not symmetrical about midplane [10]. For such an embodiment, the meaning of the word "midplane" is broadened to mean "medial" or "intermediate," such as "somewhere in the middle" rather than specifying an exact halfway point. The protuberance may thus appear offset from a plane of symmetry in such an embodiment. The closed contour may instead be projected along a curved first projection contour [P'] producing a tapered solid. A taper along a curved contour may be defined by selecting two points spaced apart along the projection contour and extending a first line segment m-m' from one point and a second line segment n-n' from the other. The taper is defined where the distance m-m' differs from the distance n-n'. Tapering the part along its orthogonal projection out of the midplane allows for left-and right-handed versions of the bow grip fixture customized for left- and right-handed archers.

Figure 7:
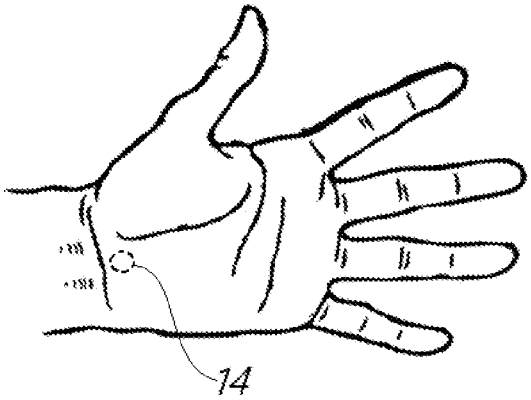
FIG. 7 shows an archer's gripping hand opened to illustrate a typical point of contact in the palm of the hand for a protuberance of a bow grip aid in accordance with the invention.

FIG. 7 shows an archer's gripping hand opened to illustrate a typical point of contact [14] in the palm of the hand for a protuberance of a bow grip aid in accordance with the invention. Its is possible for an archer to practice with the bow grip and grip the bow from one shot to the next within 1-millimeter accuracy. Many people have one or more natural creases in this area of the palm, and tactile sensitivity within those furrows is sharply increased. A person is much more sensitive to whether or not a tactile stimulus falls within a palm groove or not than to where exactly a tactile stimulus occurs on a smooth, uninvected portion of the palm. By fitting the bow grip aid to the bow so that the tip of its protuberance registers into one of these creases, locational consistency of the gripping hand on the bow grip is substantially increased because the sensing task is simplified from a two-dimensional task of registering a contact point on a membrane surface to a one-dimensional task of registering a contact point constrained within a groove.

Figure 8A:
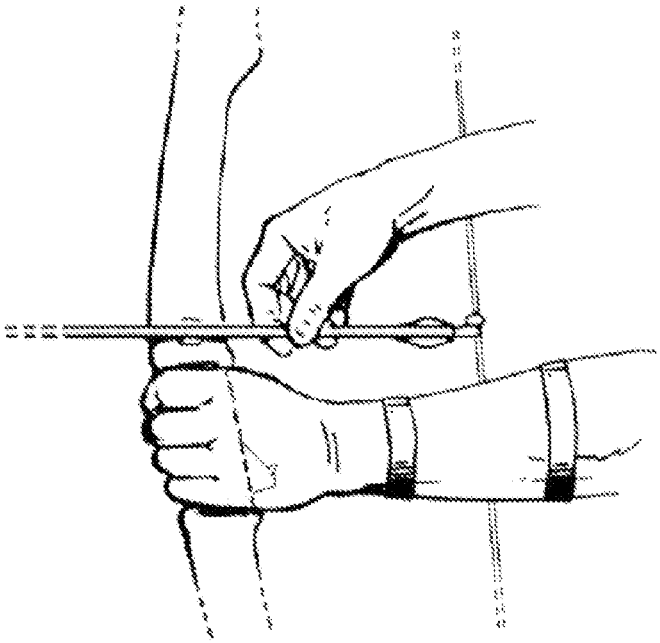
FIG. 8*a* shows an archer gripping a bow equipped with a bow grip aid in accordance with the invention, and nocking an arrow as an environment of use.

FIG. 8*a* shows an archer gripping a bow equipped with a bow grip aid in accordance with the invention, and nocking an arrow as an environment of use. The wrist potion of the gripping hand is depicted as locally transparent so that the bow grip fixture may be seen at a preferred location on a bow grip.

Figure 8B:
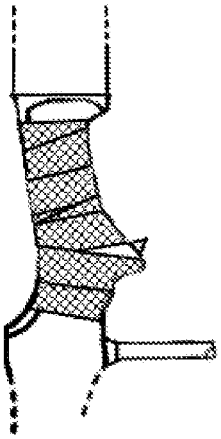
FIG. 8*b* shows a bow with a bow grip aid in accordance with the invention affixed to the bow grip by means of sports grip tape.

FIG. 8*b* shows a bow with a bow grip aid in accordance with the invention affixed to the bow grip by means of sports grip tape. The invention will work with both traditional archery bows and modern compound bow grips such as the one depicted in this figure. The grip aid may also be of service in other precision gripping tasks for other hand-held sports equipment and for tool handles.

Figure 8C:
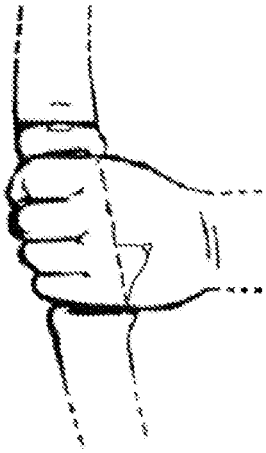
FIG. 8*c* shows an archer gripping a bow equipped with yet another alternative embodiment of a bow grip aid in accordance with the invention.

FIG. 8*c* shows an archer gripping a bow equipped with yet another alternative embodiment of a bow grip aid in accordance with the invention. It is also possible to fashion an effective solid for a bow grip fixture in which the hypotenuse surface is oriented upside-down as compared to the orientation shown in FIGS. 8*a* and 8*b*. The second projection contour defining the projection direction of the protuberance would extend on an obtuse angle with respect to the hypotenuse spline of the solid.

Figure 8D:
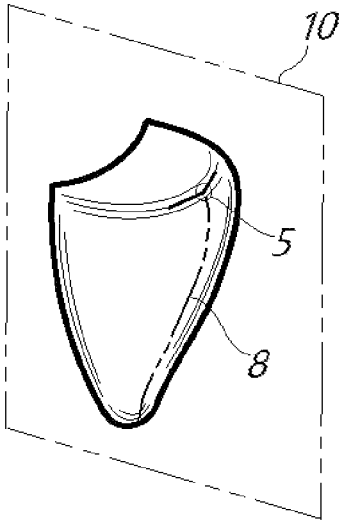
FIG. 8*d* shows another alternative embodiment of a bow grip aid in accordance with the invention.

Lastly, FIG. 8*d* shows another alternative embodiment of a bow grip aid in accordance with the invention, but having ergonomically curved surfaces. Such an embodiment may be an irregular organic shape such as an almond or be an asymmetrical projection such as the shape of a clove of garlic. The protuberance in this embodiment occurs at the confluence of two edges which join together to form a point [5]. With the apex edge as the first edges of the solid, the two edges are a second edge, and a third edge oriented at a dihedral angle from said second edge. The point of the dihedral is the tactile stimulus point sought for by the archer when seating a griping hand on the bow grip.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently, and in summary, although many exemplary embodiments are described above, it will be appreciated that the invention is intended to cover all modifications and equivalents within the scope of the following claims.

What is claimed is:

1. A bow grip aid configured for attachment to an archery bow grip, the bow grip aid comprising;
- a midplane
- a solid defining a closed contour lying within said midplane,
- a first projection contour extending orthogonally to said midplane, said closed contour further comprising
  - an apex
  - an adjacent spline extending from said apex and lying within said midplane, and
  - a hypotenuse spline extending from said apex and lying within said midplane, with said solid further comprising
  - a first edge passing through said apex,
  - an adjacent surface extending from said first edge along said adjacent spline,
  - a hypotenuse surface extending from said first edge along said hypotenuse spline, and
  - a protuberance positioned below a top portion of the hypotenuse spline and on the bow grip aid, wherein the protuberance is pointed, and wherein a tip of the protuberance is configured to engage a palm of a gripping hand of an archer while holding an archery bow grip with an attached bow grip aid in a shooting position.

2. The bow grip aid of claim 1, wherein said solid further comprises a distal surface extending from a second edge of said adjacent surface.

3. The bow grip aid of claim 1, wherein said solid tapers along said first projection contour.

4. The bow grip aid of claim 1, wherein said solid further comprises a distal surface extending from a second edge of said hypotenuse surface.

5. The bow grip aid of claim 1, wherein said solid further comprises a surface selected from the set of surfaces consisting of:
- a plane, a concave surface, a convex surface, a positively curved surface, and a negatively curved surface.

6. The bow grip aid of claim 1, wherein said adjacent surface further comprises a concave surface.

7. The bow grip aid of claim 1, wherein said protuberance tapers along a second projection contour.

8. The bow grip aid of claim 1, wherein said protuberance comprises a surface selected from the set of surfaces consisting of a plane, a cone, an ellipsoid surface, an ogive surface, and an annular surface.

9. The bow grip aid of claim 1, wherein an angle between said adjacent contour and hypotenuse contour is between 10° and 75° inclusive.

10. The bow grip aid of claim 1, wherein said protuberance comprises a pyramid having a base contour selected from the set of base contours consisting of a polygon, a triangle, a square base, a rectangle, a rhombus, an irregular polygon, and a star.

11. The bow grip aid of claim 1, wherein at least one surface of said solid tapers along said first projection contour.

12. The bow grip aid of claim 1, said solid further comprises a fillet surface.

13. The bow grip aid of claim 12, wherein said first edge is a theoretical sharp edge and said adjacent surface and said hypotenuse surface meet at said fillet surface.

14. The bow grip aid of claim 1, wherein said protuberance comprises a second edge and a third edge oriented at a dihedral angle from said second edge.

15. The bow grip aid of claim 1, wherein the bow grip aid is configured for attachment to the archery bow grip by means of sports grip tape.

16. The bow grip aid of claim 1, wherein said protuberance is positioned on a lower portion of the hypotenuse spline.

17. The bow grip aid of claim 1, wherein said protuberance is positioned on a bottom portion of the hypotenuse spline.

18. The bow grip aid of claim 1, wherein the protuberance is a sharp point.

* * * * *